US005139011A

United States Patent [19]

Moon

[11] Patent Number: 5,139,011

[45] Date of Patent: Aug. 18, 1992

[54] UNVENTED GAS-FIRED HEATER

[75] Inventor: W. Larry Moon, Killen, Ala.

[73] Assignee: Martin Industries, Inc., Florence, Ala.

[21] Appl. No.: 759,873

[22] Filed: Sep. 13, 1991

[51] Int. Cl.[5] ..... F24C 3/00

[52] U.S. Cl. ..... 126/512; 126/524; 126/546; 126/92 C; 237/50; 237/2 A

[58] Field of Search ..... 126/512, 91 R, 86, 92 R, 126/92 C, 500, 523, 524, 544, 546; 237/52, 50, 55, 53, 2 A

[56] References Cited

U.S. PATENT DOCUMENTS 2,269,387 1/1942 Weana ..... 126/512 X
2,743,720 5/1956 Dollinger ..... 126/546 X
3,159,157 12/1964 Ponto ..... 126/512
3,277,802 10/1966 Rose ..... 126/512
4,502,463 3/1985 Gregory ..... 126/512

*Primary Examiner*—Larry Jones
*Attorney, Agent, or Firm*—Phillips & Beumer

[57] ABSTRACT

An unvented gas-fired heater assembly including a base having a gas burner mounted thereon in a combustion area. Gas logs are disposed in the combustion area for heating by the gas burner. A duct assembly is provided which directs heated air from the heater assembly, and the duct assembly is height adjustable to change the height at which air is discharged from the unit. All of the components of the heater are assembled as a unit so that the unit is easily insertable and mountable in an enclosure sure as a fireplace.

6 Claims, 2 Drawing Sheets

UNVENTED GAS-FIRED HEATER

FIELD OF THE INVENTION

This invention relates generally to gas heaters and more particularly to an unvented gas-fired heater having a height adjustable duct for directing heated air into an enclosure such as a room.

BACKGROUND OF THE INVENTION

Various unvented gas heaters are found in the prior art. One such type of heater is found in U.S. Pat. No. 2,696,205, issued to Ruhl on Dec. 7, 1954. This patent is directed to a space heater which is positioned in a room to provide heat thereto. The heater includes a housing enclosing a combustion chamber wherein gas is ignited. The gas heats surrounding gridwork of the structure, and air is allowed to circulate over this heated fixed gridwork and escape into the immediate area of the heater for heating thereof. The heater does not include ducts or forced air to distribute air out of the heater, and no enclosure, such as a fireplace, is provided around the heater. Furthermore, no suggestion is made of the use of gas logs in the combustion chamber.

Applicant has provided an unvented gas-fired heater which is easily insertable into various enclosures, such as fireplaces. The heater utilizes gas logs in the combustion area to create a much greater heating surface than can be found in the U.S. Pat. No. 2,696,205. The fireplace provides a warm enclosure for the heater by retaining a large amount of heat generated in the heater combustion chamber in the immediate surrounding area of the heater. An adjustable duct assembly provides for efficient heat distribution from the heater while permitting the heater to be mounted in different sized enclosure openings.

SUMMARY OF THE INVENTION

It is, therefore, an object of the present invention to provide a gas-fired fireplace heater mountable as a unit in an enclosure such as a fireplace.

It is another object of the present invention to provide such a heater with the capability of being mounted in various sized enclosure openings while maintaining efficient heat distribution therefrom.

It is a further object of the present invention to provide such a heater with control means for preventing gas flow to and from the heater if the oxygen content of the ambient air falls below a predetermined level.

These and other objects of the present invention will become more readily apparent from the following detailed description taken in conjunction with the accompanying claims.

DESCRIPTION OF THE PREFERRED EMBODIMENT

Figure 1:
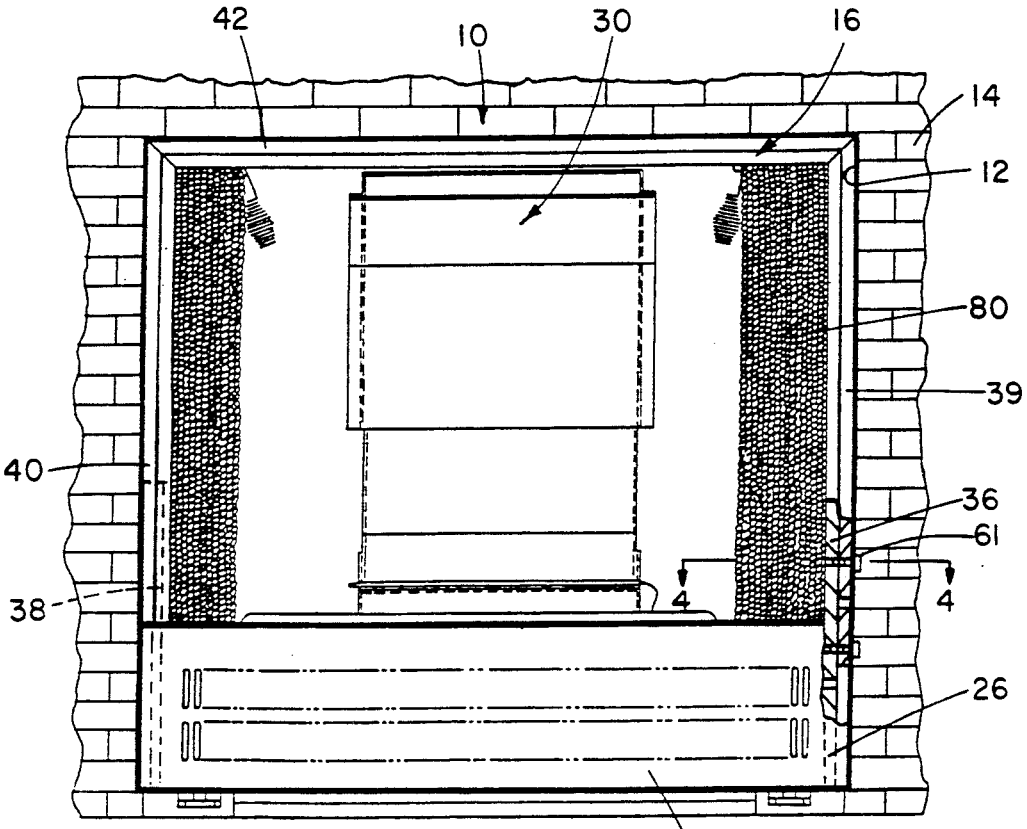
FIG. 1 is a front elevational view of the heater of the present invention positioned in a fireplace.

As seen in FIG. 1, an unvented gas-fired heater 10 is shown mounted in an opening 12 of a fireplace 14. An adjustable trim assembly (dress guard) 16 is mounted around the peripheral edges of the heater. The dress guard is adjustable to various heights so that the mating edges of the fireplace and heater are covered.

Figure 2:
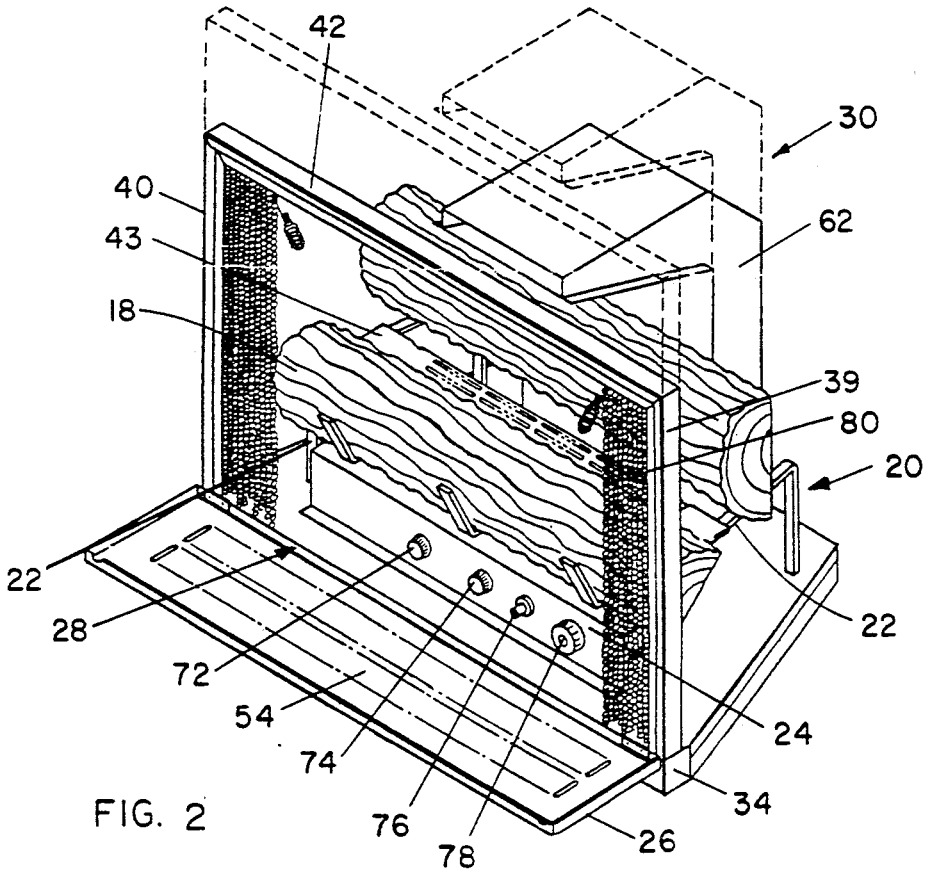
FIG. 2 is a pictorial view of the fireplace heater of FIG. 1 showing the exhaust duct placed in various positions and illustrating an adjustable dress guard.
Figure 3:
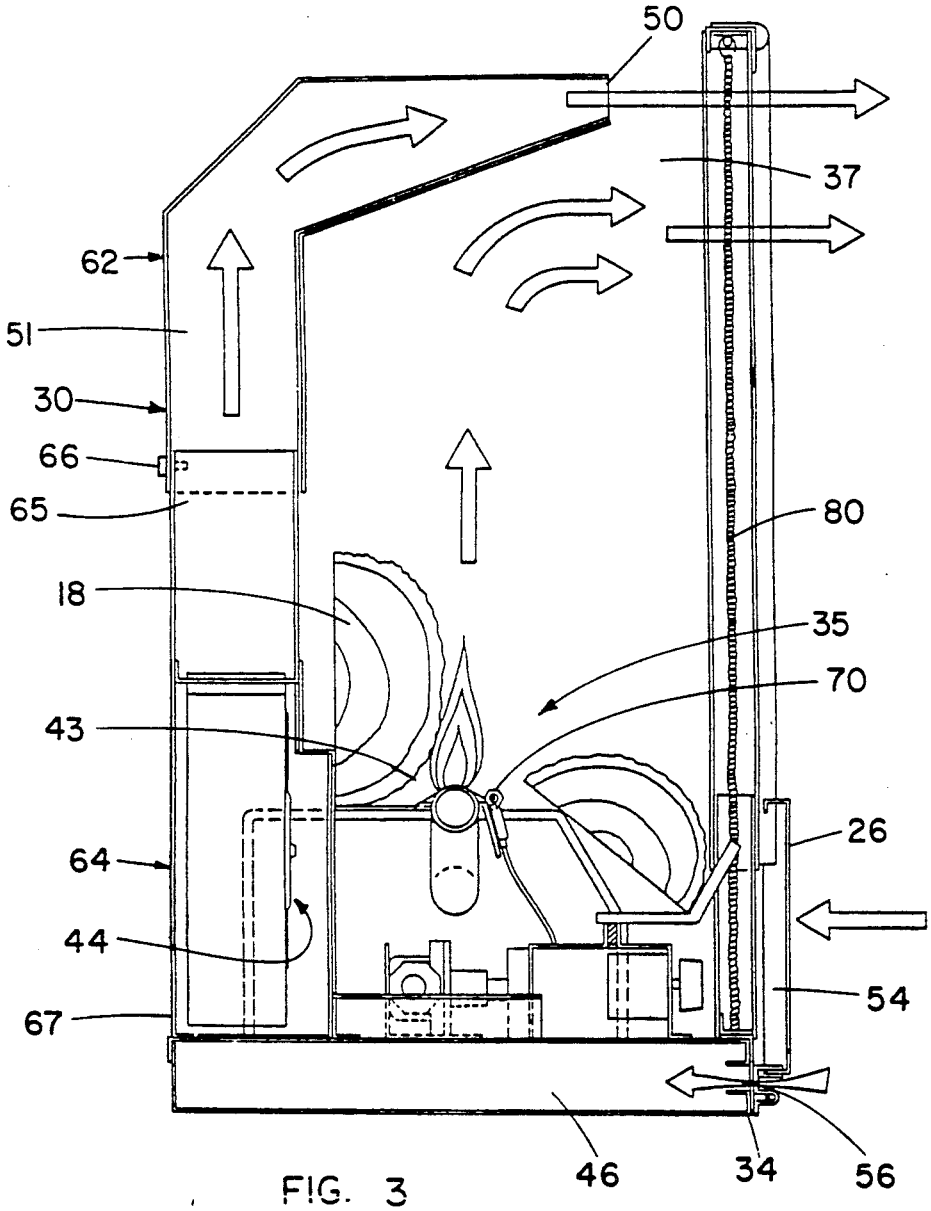
FIG. 3 is a side elevational view of the heater of the present invention.

The heater is shown in FIGS. 2 and 3 to include gas logs 18 carried on a support bracket 20 having a plurality of support arms 22. A control panel 24 is provided inside a door 26 hingedly secured to the frame 28 of the heater. An adjustable duct assembly 30 is mounted to a base member 34 having a forward portion and a rear portion and a pair of vertical supports 36 and 38 (FIGS. 1, 4, and 5) extend upwardly from the forward portion of base member 34 for slidable support of a pair of vertical trim members 39 and 40 which are secured to a horizontal trim member 42. Members 39, 40, and 42 comprise the dress guard.

A gas burner 43 is shown in FIG. 3 to be positioned adjacent to the gas logs 18 and is connected to a gas source (not shown). A blower 44 is shown mounted in duct assembly 30 for circulating room air through duct assembly 30, which includes a space 46 extending beneath combustion chamber 35 around the back of the combustion chamber 35 and over the top 37 of the combustion chamber 35. The fan 44 draws air into the duct assembly where it is heated by the ignited gas of the gas burner and by the heat emanating from the gas logs before it is discharged through the exhaust opening 50 at the top 37 of the heater. As can be seen in the figures, a grill 54 is provided in a front door 26 to admit additional combustion air into the heater from the room in which the heater is mounted.

Figure 4:
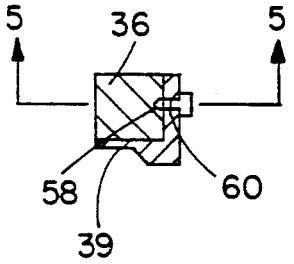
FIG. 4 is a sectional view taken along line 4—4 of FIG. 1
Figure 5:
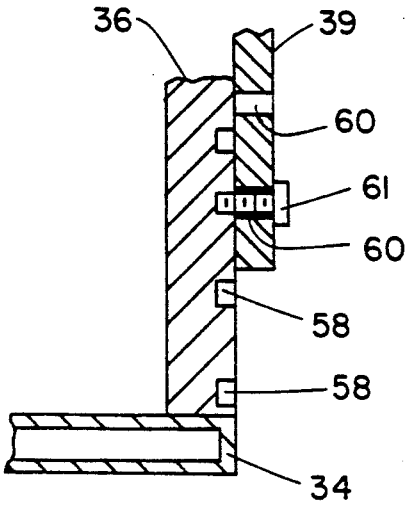
FIG. 5 is a sectional view taken along line 5—5 of FIG. 3 illustrating the structure used in adjustably supporting the dress guard members of FIG. 1 in a raised position.

To allow for the vertical adjustment of the dress guard, vertical dress guard members 39 and 40 are mounted for slidable movement on the vertical supports 36 and 38 (FIGS. 1, 4, and 5). As more clearly seen in FIGS. 4 and 5, a plurality of vertically spaced tapped holes 58 is provided in vertical support members 36 and 38 (only support member 36 is shown) for registry with a desired one of a plurality of spaced openings 60 provided in the vertical dress guard members. A screw 61 is placed in the aligned openings 58 and 60 to retain the vertical dress guard member at the desired height. Typically, the dress guard members are chrome finished, and the outer room-facing surfaces of the vertical supports may be chrome finished to provide a heat appearance.

The duct assembly 30 (FIG. 3) includes a lower section 64, an upper section 62, and an intermediate section 64. The upper section 62 includes outlet portion 50 and a vertically extending portion 51. The intermediate section 64 includes an upper portion 65 and a lower portion 67. Upper portion 65 is disposed in telescoping relation in portion 51 of upper section 62. Lower portion 67 of intermediate section 64 is mounted to base 34 and is disposed in communication with plenum chamber 46 which forms the lower section of duct assembly 30. Plenum chamber 46 includes an inlet opening 56 communicating externally of the heater assembly to admit air to blower 44.

As a safety feature, an oxygen depletion sensing valve assembly 70 is secured in the gas line upstream of the pilot and main burner of the heater. Assembly 70 is mounted in the combustion chamber in the general vicinity of the gas burner and gas logs. The oxygen sensing valve assembly 70 senses when the oxygen in the combustion chamber has been substantially depleted and shuts down the gas flow to the heater. Valve assembly 70 includes a thermocouple which generates electricity (approximately 30 mv) as long as it is subjected to heat by the burner flame. The electricity energizes an electromechanical device which keeps passages to the main burner and pilot open, which allows gas flow to the pilot and main burner. The pilot burner is designed to be sensitive to oxygen content of ambient air; and when the oxygen content of ambient air is reduced to approximately 18 percent, the flame is extinguished, the thermocouple cools, and the electricity generated is reduced to the point that the electromechanical device cannot keep the passages open to permit gas flow to the pilot and main burner, thus stopping all gas flow from valve assembly 70. Such oxygen depletion sensing systems are well known in the art, and the device used in the present invention may be similar to those manufactured by Sourdillon (France).

To control the operation of the device, control panel 24 is provided with a blower speed control 72, a blower thermostat control 74, a piezo ignitor 76, and a burner control thermostat 78. A wire screen 80 is provided at the front of the heater assembly.

It is to be understood (and as seen in FIG. 2) that all of the components which make up the heater assembly, including the movable ducts and the movable dress guard, are assembled as a unit and are, therefore, easily movable and mountable in different enclosure openings of varying sizes.

It is also to be understood that when the unitary gas-fired unit is installed in a fireplace, the damper is to be sealed closed so that heat produced by the heater is retained in the enclosed space around the heater assembly to be substantially exhausted into the area (such as a room) to be heated.

I claim:

1. An unvented gas-fired heater assembly comprising:

a base having a pair of spaced, upstanding legs;

gas burner means carried on said base and adapted for connection to a source of gas, said gas disposed for ignition to provide heat in the general vicinity of said gas burner means defined as a combustion area;

a duct assembly secured to said base and having an air inlet and an air outlet, said duct assembly including a lower section provided with said air inlet and disposed in said base below said combustion area, an intermediate section communicating with said lower section and positioned behind said combustion area, and an upper horizontal section communicating with said intermediate section, said upper horizontal section positioned above said combustion area and provided with said outlet;

said base, said gas burner means, and said duct assembly being secured together to form a unitary portable structure adapted for insertion as a unit into an enclosure, such as a fireplace;

means for adjusting the height of said duct assembly for changing the height at which said heated air is directed from said duct outlet;

fan means disposed in said duct assembly for drawing air into said duct assembly for circulation through said duct assembly and for discharge out of said enclosure;

at least one gas log mounted in said combustion area for heating by said ignited gas;

trim means mounted to said base for trimming the adjacent edge surfaces of said opening of said enclosure, said trim means including a pair of vertical trim members and a horizontal trim member extending between said vertical trim members, and securing means for adjustably securing said vertical trim members to said upstanding legs; and control valve means connected to said source of gas and disposed in said combustion area to sense when oxygen in said combustion area is substantially depleted and to shut off the supply of said gas to said gas burner means responsive to depletion of the oxygen level in said combustion area below a predetermined oxygen level.

2. An unvented gas-fired heater assembly comprising:

a base having a pair of upstanding, spaced legs;

gas burner means carried on said base and adapted for connection to a source of gas, said gas disposed for ignition to provide heat in the general vicinity of said gas burner means defined as a combustion area;

a duct assembly secured to said base and having an air inlet and an air outlet, said duct assembly including a lower section provided with said air inlet and disposed in said base below said combustion area, an intermediate section communicating with said lower section and positioned behind said combustion area, and an upper horizontal section communicating with said intermediate section, said upper horizontal section positioned above said combustion area and provided with said outlet;

said base, said gas burner means, and said duct assembly being secured together to form a unitary portable structure adapted for insertion as a unit into an enclosure having an opening provided with peripheral edge surfaces;

means for adjusting the height of said duct assembly for changing the height at which said heated air is directed from said duct outlet;

trim means disposed for adjustably secured relation to said upstanding legs, said trim means disposed around the periphery of said heater assembly in overlapping relation with said edge surfaces of said opening in said enclosure; and means for securing said trim means to said upstanding legs.

3. Apparatus as set forth in claim 2 wherein said trim means includes a horizontally extending member having a pair of spaced downwardly depending legs secured thereto, each of said downwardly depending legs disposed in mating, slidable relation with a respective said upstanding leg of said pair of upstanding legs.

4. Apparatus as set forth in claim 3 wherein said means for securing said trim means to said upstanding legs are screw means disposed for engaged relation with said trim means and said upstanding legs.

5. Apparatus as set forth in claim 4 wherein said base includes a rear and a forward portion, said upstanding, spaced legs being secured to said forward portion of said base.

6. Apparatus as set forth in claim 5 including control valve means connected to said source of gas and disposed in said combustion area to sense when oxygen in said combustion area is substantially depleted and to shut off the supply of said gas to said gas burner means responsive to depletion of the oxygen level in said combustion area below a predetermined oxygen level.

* * * * *